United States Patent [19]

Zaltzman et al.

[11] Patent Number: 4,861,464

[45] Date of Patent: Aug. 29, 1989

[54] METHOD AND APPARATUS FOR SEPARATION USING FLUIDIZED BED

[75] Inventors: Arthur Zaltzman, Bat-Yam; Zeev Schmilovitch, MOB P. Ephraim, both of Israel; Brahm P. Verma, Griffin, Ga.; Aharon Hoffman, Ramat-Gan, Israel

[73] Assignee: State of Israel, Ministry of Agriculture, Jerusalem, Israel

[21] Appl. No.: 55,705

[22] Filed: May 29, 1987

[51] Int. Cl.[4] ..... B07B 4/08; B07B 11/00; B07B 13/08

[52] U.S. Cl. ..... 209;474; 209/486; 209/492; 209/493; 209/498; 209/502

[58] Field of Search ..... 209/19, 20, 44, 44.1, 209/422, 466–469, 474–476, 485–486, 487–494, 497–499, 502, 508

[56] References Cited

U.S. PATENT DOCUMENTS

| | | | |
|---|---|---|---|
| 1,068,162 | 7/1913 | Payne | 209/486 X |
| 1,634,898 | 7/1927 | Delamater | 209/476 |
| 1,801,195 | 4/1931 | Fraser | 209/474 |
| 1,837,299 | 12/1931 | Taggart | 209/485 X |
| 2,007,190 | 7/1935 | Fraser | 209/474 |
| 2,093,470 | 9/1937 | Morgan | 209/474 |
| 2,303,367 | 12/1942 | Kendall et al. | 209/492 X |
| 3,367,501 | 2/1968 | Eveson | 209/492 X |
| 3,674,144 | 7/1972 | Muller et al. | 209/475 X |
| 3,984,306 | 10/1976 | Sayles et al. | 209/474 X |
| 4,035,288 | 7/1977 | Gibert et al. | 209/502 X |
| 4,322,287 | 3/1987 | Zaltzman et al. | 209/44 |

FOREIGN PATENT DOCUMENTS

| | | | |
|---|---|---|---|
| 0565956 | 12/1932 | Fed. Rep. of Germany | 209/474 |
| 2848474 | 5/1979 | Fed. Rep. of Germany | 209/474 |
| 0946480 | 1/1964 | United Kingdom . | |
| 1153722 | 5/1969 | United Kingdom . | |
| 2078552 | 1/1982 | United Kingdom . | |

OTHER PUBLICATIONS

Zaltman, Feller, Mizrach and Schmilovitch, "Separating Potatoes from Clods and Stones in a Fluidized Bed Medium," *Transactions of the ASAE*, vol. 26, No. 4, pp. 987–990 and 995 (1983).

Clarke, "Cleaning Seeds by Fluidization," J. Agric. Engng. Res., 31, pp. 231–242 (1985).

*Primary Examiner*—Robert B. Reeves
*Assistant Examiner*—Edward M. Wacyra
*Attorney, Agent, or Firm*—Workman, Nydegger, Jensen

[57] ABSTRACT

A gas is forced upwardly through a fluidization medium, such as sand, producing a fluidized bed which flows under the influence of gravity through an inclined trough. The separation of the side walls of the trough decreases in the direction of flow of the fluidized bed increasing the depth thereof. The apparent density of the fluidized bed is maintained substantially uniform, regardless of the increase in depth, by correspondingly increasing the pressure of the air forced through the medium in a manner corresponding to the depth thereof. A gas distribution plate beneath the fluidization medium having a higher resistance to the flow of gas than the layer of fluidization medium thereabove contributes to the maintenance of a substantially uniform apparent density in the fluidized bed despite variations in its depth. The fluidized bed will separate mixture of articles added thereto into a float fraction of articles having densities less than the density of the fluidized bed and a sink fraction of articles of correspondingly greater densities. Upper and lower layers of the fluidized bed entraining float and sink fractions of the mixture, respectively, are separated at the output end of the trough and cleaned of fluidization medium. The method and apparatus disclosed have demonstrated utility in the separation and sorting of agricultural products of all sizes and particularly of products greater than 5 millimeters in diameter.

54 Claims, 4 Drawing Sheets

METHOD AND APPARATUS FOR SEPARATION USING FLUIDIZED BED

BACKGROUND OF THE INVENTION

1. Field of the Invention

The present invention relates to methods and apparatus using fluidized bed principles for separating mixtures of solid articles of different densities, and more particularly two such methods and apparatus as are applicable to the gading of agricultural products or the separation of agricultural products from associated waste materials.

2. Background Art

The use of density variation as a means of separating articles is widespread. In agriculture the separation and sorting of products on this basis is accomplished using both wet and dry methods.

Wet methods use a liquid as a medium in which to separate denser articles, which will sink in the given liquid, from lighter ones that will float thereupon. Current density-based agricultural sorting techniques that use liquids employ water and various solutions thereof that include, for example, salt or alcohol.

Because of the use of fluids, these techniques have inherent disadvantages which limit their application with agricultural products. Many of the liquids employed are expensive and present fire and social hazards when used in large quantities. Some agricultural commodities, such as peas or blueberries, need preliminary prewetting in order to remove air bubbles and permit their effective sorting using fluids. Other products, such as peanuts, walnuts, and pecans, cannot generally be processed in any liquid because the absorption of liquid adversely affects the properties of the product.

In instances where sorting requires grading of agricultural products into three or more categories, the use of several liquids in succession or the changing of liquids in a single sorting apparatus is required. The preconditioning of produce prior to wetting or the rinsing of produce subsequent to sorting are also often necessary when liquids are used for this purpose. These operations often deteriorate product quality and the freedom with which the products may be stored thereafter. In addition, the liquids involved frequently become contaminated with foreign materials during the sorting process, affecting their density and requiring periodic changing or filtering of the liquids.

Dry methods of sorting or cleaning of agricultural products are not afflicted by the above-described disadvantages. Some dry methods of sorting employ a form of pneumatic separation based on a combination of differing density and differing aerodynamic properties associated with the components to be separated. In such separation schemes, a gas, such as air, is forced upwardly through a moving bed of the mixture to be separated. This gas flow through the interstices of the particles of the mixture tends to disengage those particles from each other permitting the gas flow to support at least some of the weight thereof. As a result, the bed resembles a liquid of high viscosity and the particles of the mixture are freed to a degree to migrate within the bed under the influence of physical forces that might tend to induce a separation among the constituent components. In this respect, such methods employ fluidized bed principles.

Nevertheless, the separation that occurs when a mixture to be separated is itself fluidized is not one that occurs due exclusively to differing density among the components of the mixture. Instead, the aerodynamic properties of the particles of the mixture also have a substantial impact upon the rate and quality of separation that results, as the upward flow of gas through the bed of the mixture will tend to draw with it the less compact particles of the mixture, regardless of their density. Such separators are disclosed in Great Britain Pat. No. 1,153,722 and Great Britain Pat. application No. 2,078,552 A. Both involve the separation of a mixture of small granular materials through a pneumatically induced fluidization of the mixture as it passes down an inclined chute. At the discharge end of each chute the mixture of materials has become somewhat stratified according to the combined density and aerodynamic properties of the component particles. Such devices have several inherent drawbacks which render them less than optimally desirable in relation to the broad range of circumstances in which agricultural separators of the dry variety are desirable.

First, separators which pneumatically fluidize the actual mixture to be separated have a limited separation effectiveness. While the upper and lower layers of the stratified flow of the mixture discharged from the end of the separator chute may be relatively pure, the layers intermediate thereto continue to comprise a mixture of particles of both densities.

This failure to achieve a distinct separation at the intermediate layers of the discharge stream is ameliorated to some extent in Great Britain Pat. application No. 2,078,552 A by horizontally narrowing the separation between the vertical walls of the chute in the vicinity of its discharge end. This has the effect of increasing the depth of the flow at the point of discharge, affording more vertical distance between the separated top and bottom layers of the mixture. Nevertheless, at some point between those two layers, the two materials of differing densities remain substantially intermixed in an interface layer. This fact precludes the achievement of optimal separation effectiveness.

A second, more profound drawback of separation methods in which the mixture to be separated is itself pneumatically fluidized arises from the fact that fluidization of a mixture is not possible if the particles of the mixture have diameters greater than or three or four millimeters. Such methods are thus effective only in separating small products such as cereal grain. Dry separation methods and apparatus which attempt to achieve separation by fluidization of the material to be separated accordingly cannot be used to sort or separate larger produce.

In order to separate large products, resort has been made to the use of fluidized beds which are constituted of a material other than the mixture to be separated. For the purpose of separating mixtures of larger solid bodies of different densities, a fluidized bed created from such a fluidization medium behaves in a manner analogous to a liquid Pieces of solid material less dense than the apparent density of the fluidized bed will float on the surface thereof. These will hereinafter be referred to as the "float fraction" of that mixture. Pieces of solid material which are more dense than the apparent density of the fluidized bed will on the other hand sink to the bottom of the bed. These will hereinafter be referred to as the "sink fraction" of the mixture. This method of separating bodies of differing densities in a mixture is aptly termed a sink-float fluidized bed separation process.

For such separation to occur, the apparent density of the fluidized bed must be intermediate the densities of the float and sink fractions of the mixture. Additionally, the particle size of the fluidization medium must be smaller by several orders of magnitude than the size of the bodies of the mixture.

The apparent density of the fluidized bed, $\rho$, can be expressed as:

$$\rho=(1-\epsilon)\,\rho_s+\rho_f$$

where $\rho_s$ is density of the particles of the fluidization medium, $\rho_f$ is the density of the fluidizing gas, and $\epsilon$ is the void fraction of the fluidized bed, a variable highly dependent upon the rate of gas flow through the bed. In fluidization, it is important to increase the rate of gas flow until bubbles appear, and the bed resembles a boiling liquid. In this condition, the bed mixes continuously and the particles thereof experience an acceptable degree of mobility.

The use of a fluidization medium other than the mixture to be separated advantageously reduces the influence on the process of other separation factors, such as aerodynamic characteristics, and reduces the process to one in which separation is accomplished substantially on the basis of differing density only. In addition, the presence of a layer of fluidization medium intermediate the float fraction of the mixture on top of the fluidized bed and the sink fraction of the mixture at the bottom thereof permits clean separation of the float and sink fractions. When the mixture itself is fluidized, an intermediate layer results which is a mixture of lighter and heavier components. By contrast, in sink-float fluidized bed separators, the layer intermediate the float and sink fractions of the mixture is composed of fluidization medium, permitting close to one hundred percent separation effectiveness.

Several types of sink-float fluidized bed separators for solid materials are described in British Pat. No. 946,480. FIG. 1 of that patent involves a fluidized bed that is reconstructed continuously on a horizontally moving conveyor. A mixture to be separated into its float and sink fractions is added to the fluidized bed and allowed to separate while the bed is transported horizontally on the conveyor. At the end of this travel, the float and sink fractions of the mixture are extracted as the fluidization material is dumped from the end of the conveyor for recycling. Such an apparatus has the drawback of being unable to contain the loss of air pressure at the edges of the bed-carrying conveyor. This results in a nonuniform density across the width of the fluidization bed, creating dysfunctional currents therewithin and impairing separation reliability at the margins of the conveyor. Poor separation efficiency results.

Other sink float fluidized bed separating methods illustrated in FIGS. 2 and 3 of British Pat. No. 946,480 involve stationary, bath-type fluidized beds. In the embodiment shown in FIG. 2, float and sink fractions of the mixture are sifted out of the fluidized bed by a rotary rake containing a plurality of banks of tines which cooperate with a grid of rods within the fluidized bed to sift low density and high density solid objects from the top and bottom respectively thereof. This particular embodiment of a separator is highly susceptible to jamming by bodies becoming lodged between the grid of rods and the moving tines of the rotary rake. Produce damage is common. Furthermore, the device must be extremely large to accommodate an effectively functioning rotary rake. Maintenance problems arising from the need to have the rake contact the bottom of the container of the fluidized bed are not uncommon. Poor separation efficiency is achieved in this design also.

The sink-float fluidized bed separator described in British Pat. No. 946,480 in relation to FIG. 3 uses a bath-type, sink-flat fluidized bed in which currents are induced through intentionally created gradients of fluidized bed density. These density gradients are a result of an uneven distribution of airholes in the bottom of the container of the bed. The purpose of the currents induced is to migrate float and sink fractions of the mixture to opposite sides of the fluidized bed, where they are removed on conveyors. Nevertheless, uneven density throughout the fluidized bed gives rise to variable separation capacity depending upon location therewithin. This lack of control of apparent density impairs the separation capacity of the device.

U.S. Pat. No. 4,322,287 pertains to a sink-float bath-type fluidized bed separator for agricultural purposes. In the device disclosed, a constant density bath of uniform depth is created from a fluidization medium in a separation chamber to which a mixture for separation is added. The float and sink fractions of the mixture are removed from the fluidized bed by perforated conveyors that pass therethrough. In such devices, product damage is common due to the use of the mechanical means employed to feed the mixture into the fluidization bed and to remove the float and sink fractions therefrom. The presence of conveyor mechanisms within the fluidized bed itself interferes with airflow therethrough, compromising the uniformity of the density of the bed and impairing separation capacity. In addition, the lack of motion of the fluidized bed itself, permits particles of the mixture to be separated to accumulate in "dead zones" in the fluidized bed which cannot be accessed by the removal conveyors. The accumulation of these particles deteriorates the quality of the fluidized bed medium, requiring careful surveillance and periodic cleaning of the bed.

SUMMARY OF THE INVENTION

In light of the above-described deficiencies in prior produce sorters, the objects of the present invention will be briefly stated.

One object of the present invention is an improved method and apparatus for efficiently separating and sorting agricultural products using a dry method of separation.

Another object of the present invention is to provide such a method and apparatus which minimizes damage to the agricultural products.

Yet another object of the present invention is an improved method and apparatus for sorting agricultural products as described above which sorts exclusively on the basis of density variations among the components.

Another object of the present invention is to provide a versatile method and apparatus as are described above, which are adaptable to the sorting and separation of agricultural products of varying sizes, and particularly to larger agricultural products, such as those exceeding three to four millimeters in diameter.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a medium is used to create a moving fluidized bed of density intermediate the densities of the components of a mixture of agricultural products. Separation is effected of the components of the mixture while the mixture is moving with the fluidized bed in the direction of its flow. Less dense components of the mixture rise to the surface of the fluidized bed and are displaced therewith under the effect of the dynamic forces of the moving stream. Denser components settle to the bottom and are displaced under the effect of similar dynamic forces, as well as components of gravitational forces arising due to the slope provided to the bottom of the channel in which the fluidized bed is contained.

The apparent density of the fluidized bed is adjusted through regulation of the fluidizing gas forced therethrough to achieve an apparent density close to the transition between conditions in which none of the sink fraction of the mixture float and conditions in which none of the float fraction of the mixture sink. As a result, very high separation effectiveness occurs. The top surface of the fluidized bed containing the float fraction of the mixture are discharged separately from an underflow of the fluidized bed which entrains therewith the sink fraction of the mixture.

The separation process of the present invention is a continuous flow-through process in which the depth of the fluidized bed is increased in the direction of its flow and a uniform density to the fluidized bed is nonetheless maintained through appropriate graduation of the flow of fluidizing gas therethrough. This increase in the depth of the flowing fluidized bed is achieved by narrowing the horizontal separation of the walls of the channel in which that flow is contained. Appropriate means are provided for separating the fluidization medium from the sink and float fraction of the mixture and resupplying that fluidization medium to the upper end of the fluidized bed.

Thus, an apparatus is provided for separating a mixture of articles into a float fraction of the mixture made up of articles generally having a first density and a sink fraction of the mixture made up of articles generally having a second density that is greater than the first. In one embodiment of the present invention, the apparatus comprises a channelization means having input and output ends for containing a fluidized bed flowing under the influence of gravity from the input end to the output end, a medium feed means for supplying to the input end of the channelization means a fluidization medium from which to create a fluidized bed in the channelization means, and a mixture feed means for supplying the mixture of articles to the input end of the channelization means for entrainment in the fluidized bed. The channelization means serves to increase the depth of the fluidized bed in the direction of its flow. The apparatus also comprises pneumatic means for forcing gas upwardly through the fluidization medium in the channelization means to create from the fluidization medium a fluidized bed having a substantially uniform density, regardless of the increase in the depth of the fluidized bed in the direction of its flow. The density of the fluidized bed is intermediate the densities of the articles of the float and sink fractions of the mixture.

In one aspect of the invention, the pneumatic means comprises a pressurized gas source for forcing gas upwardly through the fluidization medium in the channelization means and pressure differentiation means communicating with the pressurized gas source for graduating the pressure of that gas to maintain the density of the fluidized bed substantially uniform along the length of the channelization means.

The pressure differentiation means comprises a perforated gas distribution plate having a high resistance to the flow of gas therethrough which supports the fluidization medium in the channelization means. In cooperation therewith is provided a sectionalizing means communicating with the pressurized gas source to direct gas therefrom through successive adjacent transverse portions of the gas distribution plate. The pressure of the gas is graduated to increase along the sectionalizing means in a manner corresponding approximately to the distance along the gas distribution plate from the input end of the channelization means.

The gas sectionalizing means itself comprises a plurality of distinct gas pressure chambers communicating with the pressurized gas source and arrayed adjacent one to another below the gas distribution plate along the length thereof A plurality of individually controllable valves are located individually between corresponding ones of the gas pressure chambers and the pressurized gas source for adjusting the pressure of the gas in each of the gas pressure chambers.

In yet another aspect of the present invention, an apparatus as described above is further provided with a divider means at the output end of the channelization means for separating an upper layer of the fluidized bed with the float fraction of the mixture entrained therein from a lower layer of the fluidized bed with the sink fraction of the mixture entrained therein. The divider means may comprise a stream splitter horizontally disposed across the width of the output end of the channelization means and including a secondary pneumatic means for forcing gas upwardly through the upper layer of the fluidized bed with the float fraction of the mixture entrained therein.

Preferably, the channelization means of the apparatus of the present invention comprises a trough inclined downwardly from the input end to the output end of the channelization means. The trough is provided with sidewalls horizontally spaced closer together at the output end of the channelization means than at its input end. Optionally, the steepness of the incline of the trough and the horizontal spacing of its sidewalls at the output end are adjustable.

In yet another aspect of the present invention, a method is provided for separating a mixture of articles into a float fraction made up of articles generally having a first density and a sink fraction made up of articles generally having a second density that is greater than the first. In one preferred embodiment, the method of the 22 present invention comprises the steps of supplying to the upper end of an inclined trough a fluidization medium from of gravity through the trough, forcing gas upwardly through the fluidization medium in the trough to produce from it a fluidized bed, and increasing the depth of the fluidized bed in the direction of its flow. The pressure of the gas forced through the fluidization medium is adjusted to maintain the fluidized bed at a substantially uniform density throughout the trough, regardless of the increase in the depth of the fluidized bed in the direction of its flow. That density is adjusted to be intermediate the densities of the articles of the float and sink fractions of the mixture that is to be separated. The method of the present invention further includes the steps of feeding to the upper end of the trough the mixture of articles for entrainment in the fluidized bed, whereby the float fraction and sink fraction of the articles of the mixture migrate to an upper and lower layer respectively of the fluidized bed as it flows through the trough. Finally, the upper layer of the fluidized bed with the float fraction of the mixture entrained therein is separated from the lower layer of the fluidized bed with the sink fraction of the mixture entrained therein, and the fluidization medium of the separated upper and lower layers is cleaned from the float and sink fractions.

In one aspect of the method of the present invention, the step of adjusting the air pressure of the gas forced through the fluidization medium includes the step of directing gas through a perforated gas distribution plate supporting the fluidization medium in said trough. The gas distribution plate has a high resistance to the passage of gas therethrough. In addition, a plurality of distinct gas pressure chambers may be arrayed adjacent one another below and along the length of the gas distribution plate. Each of a plurality of valves located individually between a corresponding one of the gas pressure chambers and the pressurized gas source are adjusted to graduate increases in the pressure of the gas in each of the gas pressure chambers corresponding to the distance along the gas distribution plate from the input end of the trough. In this manner, the fluidized bed is maintained at a substantially uniform density throughout the trough, regardless of the increase in the depth of the fluidized bed.

By use of the apparatus and method of the present invention briefly described above, an optimally reliable method and apparatus is provided for separating agricultural products without the use of wetting fluids. The increased depth of the fluidized bed in the direction of its flow permits optimally effective separation of the float and sink fractions of the mixture of agricultural products. The density of the fluidized bed is maintained substantially uniform throughout the length of the channelization means, thereby stabilizing the process of separating the float and sink fractions. Use of a gas distribution plate having a high resistance to the flow of gas therethrough assists in minimizing the impact on fluidized bed density of changes, sudden or gradual, in its depth.

The fluidized bed flows freely through the trough in which it is contained without the interference of submerged conveyors or raking mechanisms. Separated articles of the float and sink fraction of the mixture are thus completely and continuously removed from the fluidized bed with little chance of damage. As the fluidized bed is constantly flowing, no accumulation of components of the mixture to be separated can accumulate in "dead zone" portions of the bed. By employing a fluidization medium, such as sand, the method and apparatus of the present invention can be applied inexpensively to the separation of agricultural products having a wide range of sizes, including in particular large agricultural products. The method and apparatus disclosed hereinafter with some particularity has special application to the separation of potatoes from clods and rocks following harvesting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the following drawings in which.

DESCRIPTION OF THE PREFERRED EMBODIMENT

Figure 1:
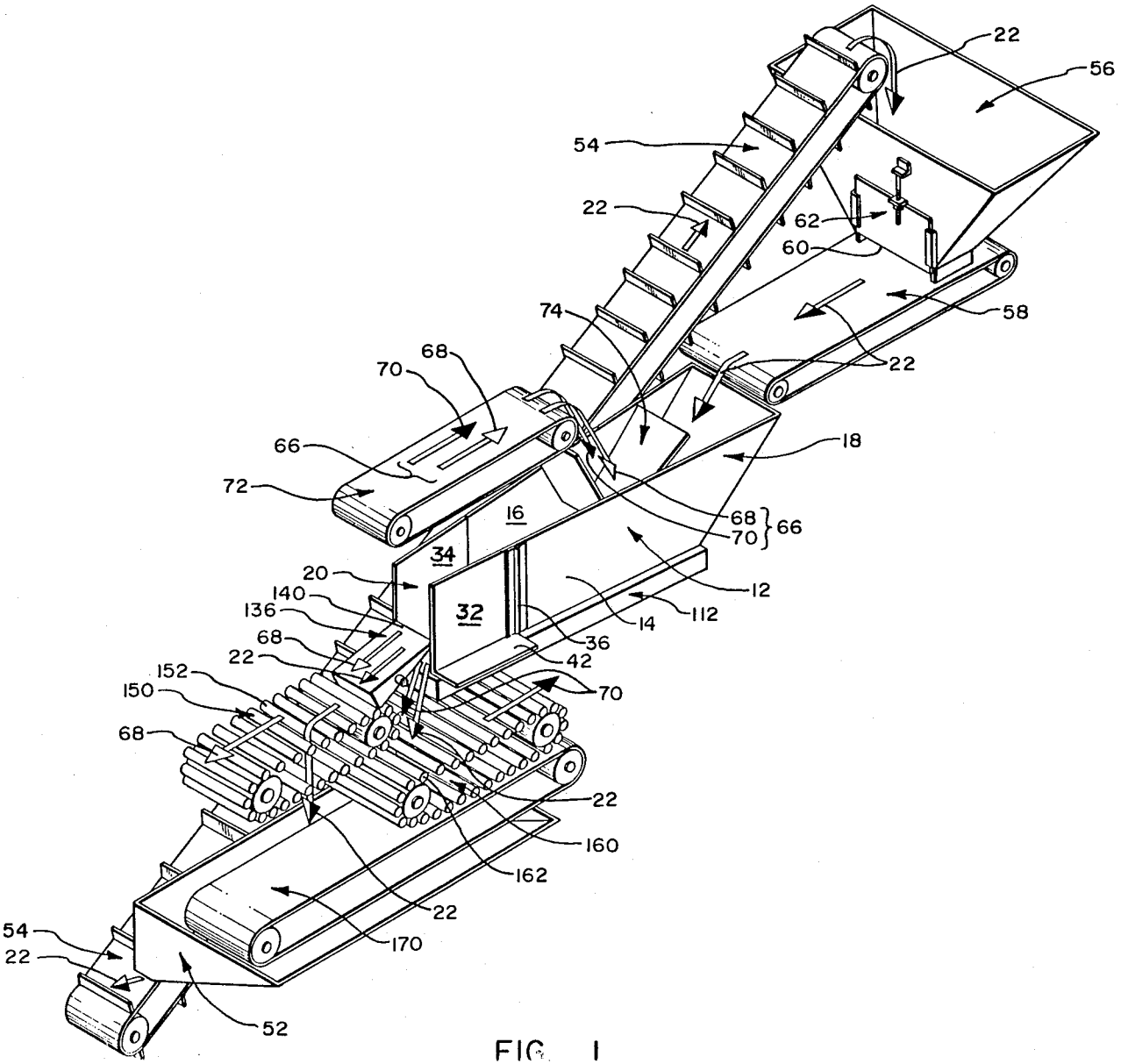
FIG. 1 is a perspective view in schematic format of one embodiment of a separator incorporating the teachings of the present invention.
Figure 2:
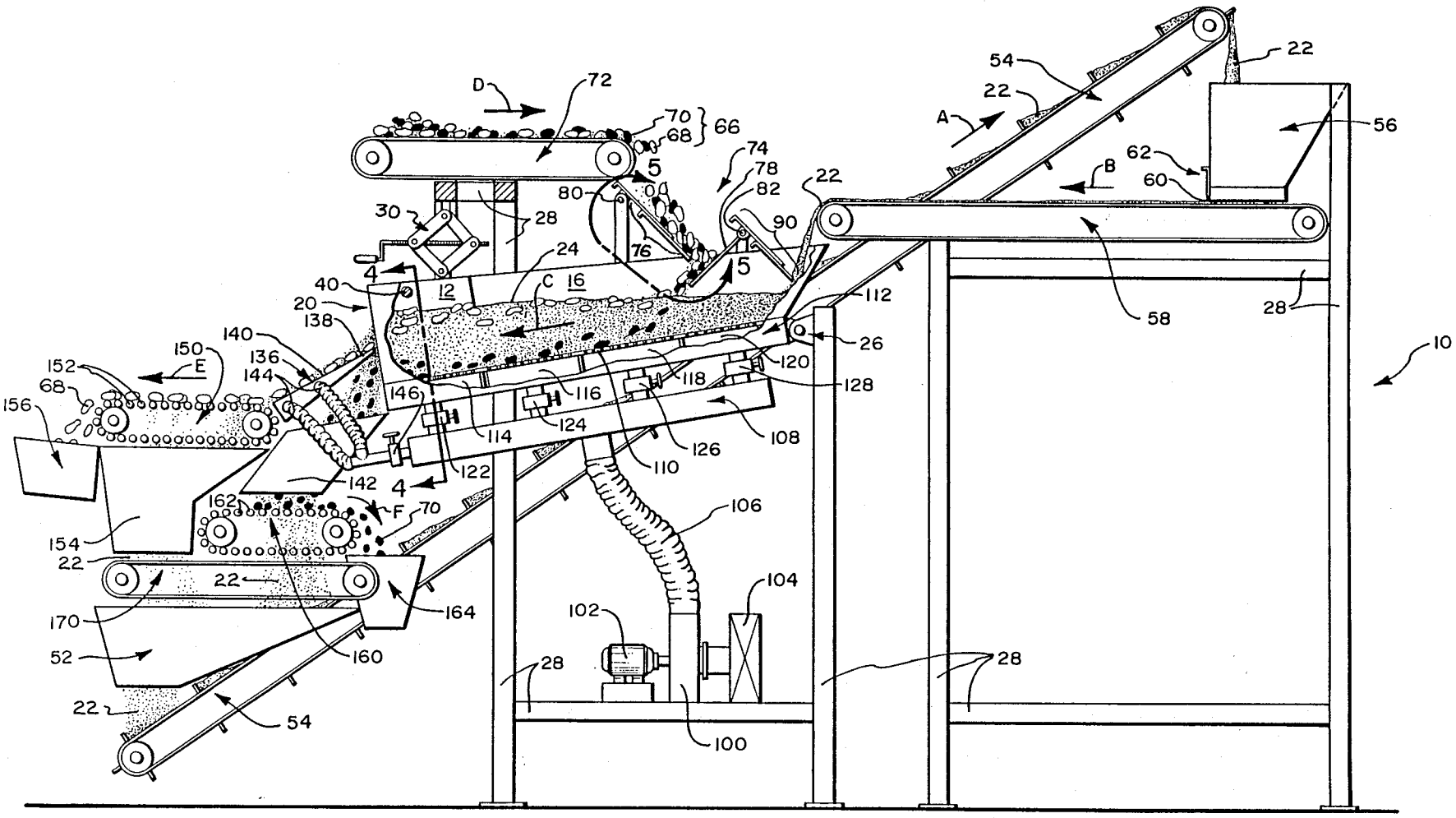
FIG. 2 is an elevation view in partial cross-section of the embodiment of the separator illustrated in FIG. 1.

FIGS. 1 and 2 taken together depict one embodiment of a separator 10 incorporating teachings of the present invention. For the sake of simplicity, supporting structure, such as frames, braces, and adjustment mechanisms for the functional components of separator 10 have been largely eliminated in FIG. 1 and in FIG. 2 have been only partially included. Also, deleted totally from the figures are power sources and drive mechanisms for the several conveyors shown, these being adequate to the purposes of the present invention if of a conventional nature.

In accordance with one aspect of the present invention, separator 10 includes a channelization means having input and output ends for containing a fluidized bed flowing under the influence of gravity from the input to the output end thereof. As shown by way of example and not limitation, an open trough 12 having upright sidewalls 14, 16 is inclined downwardly from a closed input end 18 to an open output end 20. A fluidization medium 22 is fed into input end 18 of trough 12 and fluidized pneumatically in a manner to be described hereafter to create a fluidized bed 24, shown in FIG. 2. Throughout the drawings, other than in FIG. 2, fluidization medium 22 is shown diagramatically by stylized arrows having half-darkened heads.

Due to the incline of trough 12, fluidized bed 24 flows through trough 12 in the direction indicated by arrow C in FIG. 2 toward output end 20 under the influence of gravity. In order to influence the rate of flow of fluidized bed 24, the steepness of the incline of trough 12 is rendered adjustable. As shown in FIG. 2, this may be accomplished by supporting input end 18 of trough 12 on a suitable pivot 26 from support framework 28 for separator 10. Output end 20 of trough 12 is in turn upheld from support framework 28 by a suitable means for raising and lowering output end 20, such as scissor jack 30.

Figure 3:
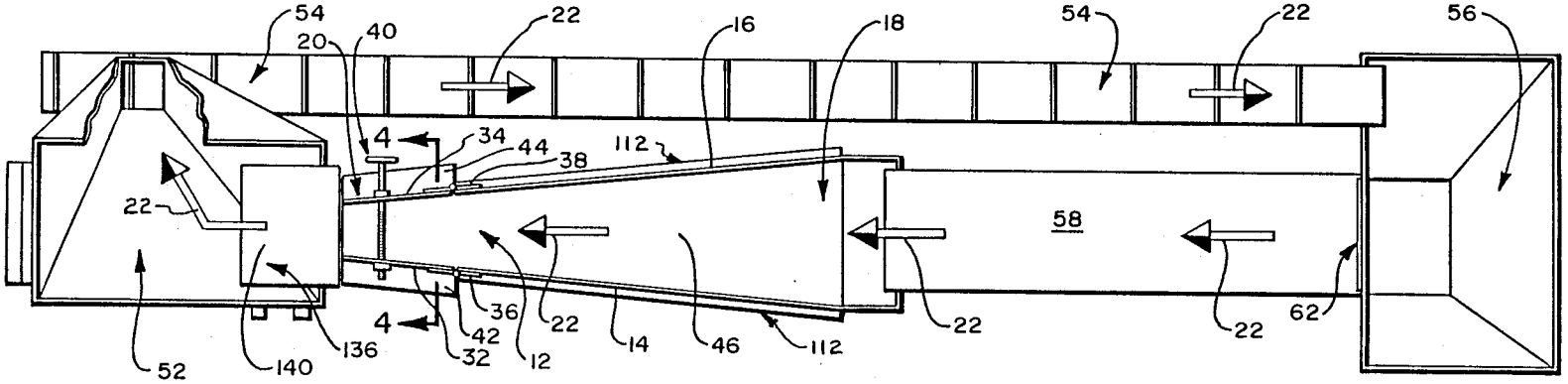
FIG. 3 is a plan view of selected elements of the sorter shown in FIG. 1.

As best seen in FIG. 3, the horizontal separation between sidewalls 14, 16 of trough 12 decreases toward output end 20 thereof. As a result, fluidized bed 24 flowing through trough 12 increases in depth along the direction of its flow, advantageously enlarging the distance between the bottom and top thereof. The degree of increase in the depth of fluidized bed 24 at output end 20 of trough 12 is a function of the degree of horizontal separation between sidewalls 14, 16 thereat. As a result, it would be appropriate to make sidewalls 14, 16 taller at output end 20 of trough 12 than at input end 18 thereof.

Figure 4:
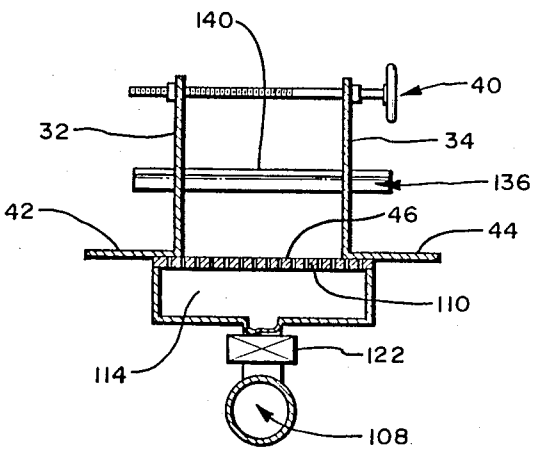
FIG. 4 is a cross-sectional view of the inventive separator of FIG. 1 taken along the section line 4—4 shown in FIGS. 2 and 3.

The extent of the increase in the depth of fluidized bed 24 as it flows through trough 12 can be varied by altering the separation of sidewalls 14, 16. As best understood from FIGS. 3 and 4 taken together, output sidewalls 32, 34 at output end 20 of trough 12 are pivotably mounted by hinges 36, 38 to sidewalls 14, 16, respectively. The horizontal separation between output sidewalls 32, 34 may then be increased or decreased by operation of a suitable manually operable output sidewall separation control device 40. For reasons which will become clearer when the gas flow through fluidized bed 24 is explained, output sidewalls 32, 34 are provided with outwardly extending skirts 42, 44, respectively, or other suitable structure which rests upon and can cover the top of bottom surface 46 of trough 12 exterior output sidewalls 32, 34.

Separator 10 includes a medium feed means for supplying to input end 18 of trough 12 a fluidization medium 22 from which to create fluidized bed 24. As shown by way of illustration, a recirculation means for collecting fluidization medium 22 from output end 20 of trough 12 and returning it to input end 18 thereof is provided comprising, for example, a collector bin 52 located below output end 20 of trough 12, a first medium conveyor 54, to and an input bin 56 located above input end 18 of trough 12. Following processing to be described subsequently, fluidization medium 22 that is discharged from output end 20 of trough 12 is consolidated in collection bin 52 and fed onto first medium conveyor 54 and lifted thereby into input bin 56 as shown by arrow A in FIG. 2. A second medium conveyor 58 removes fluidization medium 22 through an output opening 60 at the base of input bin 56 for transport in the direction shown by arrow B to input end 18 of trough 12. Output opening 60 is provided with an adjustable gate 62 which controls the amount of fluidization medium 22 removed. Gate 62 thus serves as a metering means for regulating the rate of supply of fluidization medium 22 to input end 18 of trough 12.

Separator 10 includes a mixture feed means for supplying a mixture of articles to be separated or sorted to input end 18 of trough 12. By way of example, a mixture to be designated hereinafter by reference character 66 includes articles 68 of a first density and articles 70 of a second density that is greater than the first. Under proper circumstances, articles 68 can be separated from mixture 66, forming a float fraction thereof. Similarly, articles 70 can be separated from mixture 66 as a sink fraction thereof For illustrative purposes, in all figures except FIG. 2, articles 68 of the float fraction will generally be represented by arrows with unshaded heads, while articles 70 of the sink fraction will be represented by arrows with fully shaded heads. In FIG. 2, articles 68 of the float fraction will for enhanced clarity be depicted as unshaded objects, and articles 70 of the sink fraction will be shown as fully shaded objects.

Figure 5:
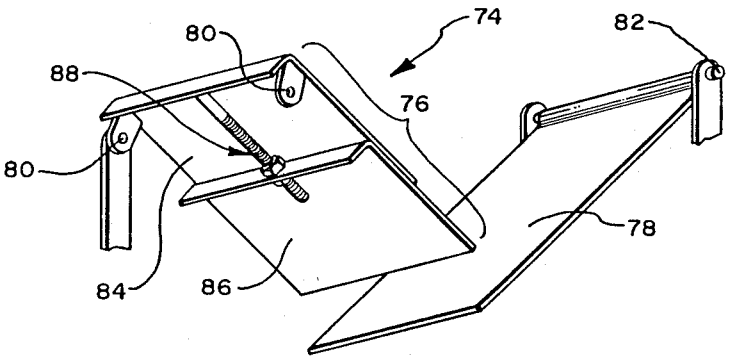
FIG. 5 is a detailed perspective view of the mixture input baffle shown at 5—5 in FIG. 2.

As shown by way of example in FIG. 2, a mixture conveyor 72 feeds mixture 66 into a mixture input baffle 74 located above input end 18 of trough 12. Baffle 74 comprises deflection plates 76, 78 each of which is pivotable about an axis 80, 82, respectively. Rather than dropping directly into fluidized bed 24, mixture 66 from mixture conveyor 72 is lowered thereto in stages by deposition first on deflection plate 76 and then on deflection plate 78. As best seen in FIG. 5, deflection plate 76 may optionally be comprised of two components, plates 84, 86, which are slidable in relation to each other to an extent determined by adjustment mechanism 88. In this manner, deflection plate 76 is adjustable in length.

This feature in combination with the pivotable mounting of deflection plates 76, 78 affords ready control of the momentum with which the articles of mixture 66 enter fluidized bed 24 and cause turbulence. The minimization of turbulence arising from the entry of mixture 66 into fluidized bed 24 increases the separation effectiveness of separator 10. For similar reasons, a pivotable fluidization medium deflection plate 90 of variable length is used to control the momentum with which fluidization medium 22 from second medium conveyor 58 is received in input end 18 of trough 12.

Whether or not means, such as baffle 74, are used to control the manner in which mixture 66 is introduced into fluidized bed 24, it has been found contributory in the successful operation of an apparatus, such as separator 10, to introduce mixture 66 into fluidized bed 24 at a point along the direction of flow thereof at which fluidization of the bed has been effected. Introduction of mixture 66 into fluidization medium 22 before fluidization medium 22 has become fluidized, noticeably impairs the ease with which fluidization is achieved along the entire length of trough 12. Thus, in input end 18 of trough 12 fluidization medium 22 should be supplied and fluidized upstream of the point at which mixture 66 is fed into input end 18. A minimum distance between the point of introduction of fluidization medium 22 and the point of introduction of mixture 66 in trough 12 of about 15 centimeters has proved sufficient to permit adequate bed fluidization to precede introduction of mixture 66.

In accordance with yet another aspect of the present invention, pneumatic means are provided in separator 10 for forcing gas upwardly through fluidization medium 22 in trough 12 to create therefrom a fluidized bed which has a substantially uniform density regardless of any increase in depth in the direction of its flow. As shown by way of example and not limitation, a blower 100 driven by a power source 102, which may be an electric motor or a small gasoline engine, serves as a pressurized gas source for gas with which to fluidize fluidization medium 22. The gas used is anticipated to typically be air. Entrance of air into blower 100 is by way of air filter 104. Air from blower 100 is directed through flexible piping 106 to a gas manifold 108 beneath trough 12.

Fluidization medium 22 in trough 12 is supported on a gas distribution plate 110 which may be a high density perforated polyethylene plate or a porous metal sheet. It has been found that in order to minimize the impact on the apparent density of fluidized bed 24 of changes in the depth thereof, gas distribution plate 110 should have a high resistance to the passage of gas therethrough. In order to achieve this objective, it is recommended that the aerodynamic resistance of gas distribution of plate 110 should be larger than the aerodynamic resistance of the layer of fluidization medium 22 supported thereon. For the purposes of sorter 10, a gas distribution plate 110 having an average opening of 30 microns and a flow rate of 50 standard cubic feet per minute per square foot has proved satisfactory.

Ultimately gas from blower 100 is directed through gas distribution plate 110 and forced upwardly through the layer of fluidization medium 22 supported thereupon. This result is effected by a gas distribution plenum 112 located below trough 12 and communicating with gas manifold 108. Gas distribution plenum 112 direct gas from blower 100 through gas distribution plate 110.

In accordance with yet another aspect of the present invention, a separator, such as separator 10, is provided with pressure differentiation means for graduating the pressure of the gas forced upwardly through fluidization medium 22 to maintain the density of fluidized bed 24 substantially uniform throughout trough 12, regardless of the increase of the depth of fluidized bed 24 in the direction of its flow. As shown by way of example, and not limitation, one embodiment of such a pressure differentiation means includes gas distribution plate 110 and a sectionalizing means for directing gas from blower 100 through successive adjacent transverse portions gas distribution plate 110.

As best appreciated in relation to FIG. 2, such a sectionalizing means may take the form in one embodiment of a sorter incorporating the teachings of the present invention f a gas plenum, such as plenum 112, made up of a plurality of distinct gas pressure chambers 114, 116, 118, 120 communicating with gas manifold 108 through a plurality of individually controllable valves 122, 124, 126, 128, respectively. Gas pressure chambers 114, 116, 118, 120 are arrayed adjacent one another beneath gas distribution plate 110 so as to direct gas from blower 100 through successive adjacent transverse portions thereof.

Valves 122, 124, 126, 128 permit individual control of the pressure of gas applied to each corresponding transverse portion of gas distribution plate 110. Individually adjusting these valves, the density of fluidization bed 24 can be determined and maintained substantially uniform, regardless of changes in its depth. This end is generally accomplished by graduating the pressure of the gas in each of gas pressure chambers 114, 116, 118, 120 so as to the distance along gas distribution plate 110 from input end 18 of trough 12. Gas pressure increases graduated in this manner will correspond approximately to the increase in the depth of fluidized bed 24 above each corresponding individual gas pressure chamber. The number of gas pressure chambers required toward this end will be determined by the length of trough 12 employed in each given instance.

In the alternative, or in cooperation with the provision of a plurality of such gas pressure chambers, the pressure of gas forced upwardly through gas distribution plate 110 can be graduated by the use of a gas distribution plate 110 having a nonuniform distribution of perforations therethrough. In particular, the density and size of the perforations through gas distribution plate 110 can individually or in cooperation be graduated along the length of trough 12 so that the resistance to the passage of gas through gas distribution plate 110 is reduced corresponding to the distance along gas distribution plate 110 from input end 18 of trough 12. In this manner, the flow of gas through distribution plate 110 and fluidized bed 24 supported thereon increases with the distance from input end 18. This increased gas flow through the deeper portions of fluidized bed 24 compensates for that increase in depth and 22 contributes to the maintenance of a constant apparent density therein. It is presently preferred, however, to utilize a gas distribution plate 110 having a uniform perforation size and density and a high resistance to gas flow therethrough, and rely on the adjustment of valves 122, 124, 126, 128 to effect the required gas pressure differentiation which will ensure a uniform density in fluidized bed 24.

The necessity for skirts 42, 44 attached to output sidewalls 32, 34, respectively, can now be readily appreciated. As output sidewalls 32, 24 are adjusted inwardly toward each other, peripheral portions of gas distribution plate 110 with perforations therethrough cease to be beneath fluidized bed 24, but are exposed on the opposite sides of output sidewalls 32, 34 therefrom. These exposed perforations through gas distribution plate 110 would, in the absence of skirts 42, 44, be vented to the atmosphere, resulting in a loss of air pressure in the system. Substantial venting of this type could preclude effective differentiation of gas pressure along the length of trough 12.

At output in 20 of trough 12 sorter 10 is provided with a divider means for separating an upper layer of fluidized bed 24 with the articles 68 of the float fraction of mixture 66 entrained therein from a lower layer of fluidized bed 24 with the articles 70 of the sink fraction of mixture 66 entrained therein. As shown by way of example, and best understood with reference to FIG. 2, a stream splitter 136 is horizontally disposed across the width of output end 20 with a lead edge 138 thereof directed toward the flow of fluidized bed 24. Stream splitter 136 is rendered pivotable and vertically moveable, so that the position of lead edge 138 may be placed at any convenient or preferred point up and down fluidized bed 24 as it emerges from trough 12. As fluidized bed 24 flows from trough 12 the upper layer thereof carrying with it the articles 68 of the float fraction of mixture 66 pass over top surface 140 of stream splitter 136 and are thus separated from the lower layer of fluidized bed 24 which carries with it the articles 70 of the sink fraction of mixture 66. The lower layer of fluidized bed 24 and the sink fraction of mixture 66 therewith thus pass below stream splitter 136 and fall from output end 20 into first output chute 142 for direction to further processing to be described presently. In the meantime, the upper layer of fluidized bed 24 with the float fraction of mixture 66 flows across top surface 140 of stream splitter 136 for further processing which will also be described presently.

Optionally, stream splitter 136 may be provided with a secondary pneumatic means for forcing gas upwardly through the upper layer of fluidized bed 24 with the float fraction of mixture 66 entrained therein as that upper layer flows over stream splitter 136. Advantageously the effect of this feature is to continue the fluidization of the upper layer of fluidized bed 24, even after it has left trough 12. As a result, the flow of that upper layer across stream splitter 136 is facilitated, preventing the backup of fluidization medium 12 and articles entrained therein upon top surface 140 of stream splitter 136. This in turn prevents slowing of the top surface of fluidized bed 24 at output end 20 of trough 12.

In order to accomplish this objective, top surface 140 of stream splitter 136 is provided with perforations, and a gas manifold within stream splitter 136 beneath such a perforated top surface 140 is connected to a pressurized gas source, such as blower 100, through flexible hoses 144 connected to gas manifold 108. A valve 146 is inserted between gas manifold 108 and flexible hoses 144 to permit control of the pressure of the gas directed by the gas manifold through stream splitter 136.

After passing across the top of stream splitter 136, the top layer of fluidized bed 24 is processed in a first cleaning means for separating fluidization medium 22 from the articles 68 from the float fraction of mixture 66 entrained therein. As seen in FIGS. 1 and 2 together, this mixture of fluidization medium 22 and the float fraction of mixture 66 is deposited on the surface of a first output conveyor 150 which has formed therethrough a plurality of openings of a size intermediate that of the particles of fluidization medium 22 and the articles 68 of the float fraction of mixture 66. As shown by way of example, the openings in conveyor 150 comprise gaps between a series of separated rollers 152. The particles of fluidization medium 22 pass through the surface of first output conveyor 150 and are directed for further processing by second output chute 154. Article 68 of the float fraction of mixture 66 on the other hand are retained on first output conveyor 150 and moved as shown by arrow E of FIG. 2 to float fraction storage bin 156. Alternately the float fraction may be removed from the vicinity of separator 10 on suitable additional conveying means.

The lower layer of fluidized bed 24 with article 70 of the sink fraction of mixture 66 entrained therein receive similar treatment below first output chute 142 by a second cleaning means which separates fluidization medium 22 from the articles 70 of the sink fraction of mixture 66. This is accomplished by a second output conveyor 160 comprising a sequence of spaced rollers 162. The particles of fluidization medium 22 pass through second conveyor 160, while the articles 70 of the sink fraction of mixture 66 are retained thereon and moved in the direction indicated by arrow F of FIG. 2 into sink fraction storage bin 164. Alternatively, the sink fraction may be removed from the vicinity of separator 10 on suitable additional conveying means.

Typically, small articles of mixture 66 will fall with particles of fluidization medium 22 through the openings in first output conveyor 150 and second output conveyor 160, respectively. These smaller ingredients of mixture 66 are directed to a finely perforated cleaning conveyor 170 through which particles of fluidization medium 22 pass, while the smaller particles of mixture 66 are sifted therefrom and removed from the system. Ultimately, particles of fluidization medium 22 are collected below cleaning conveyor 170 in collection bin 52 for transfer to first medium conveyor 54 and recirculation to input end 18 of trough 12.

Figure 6:
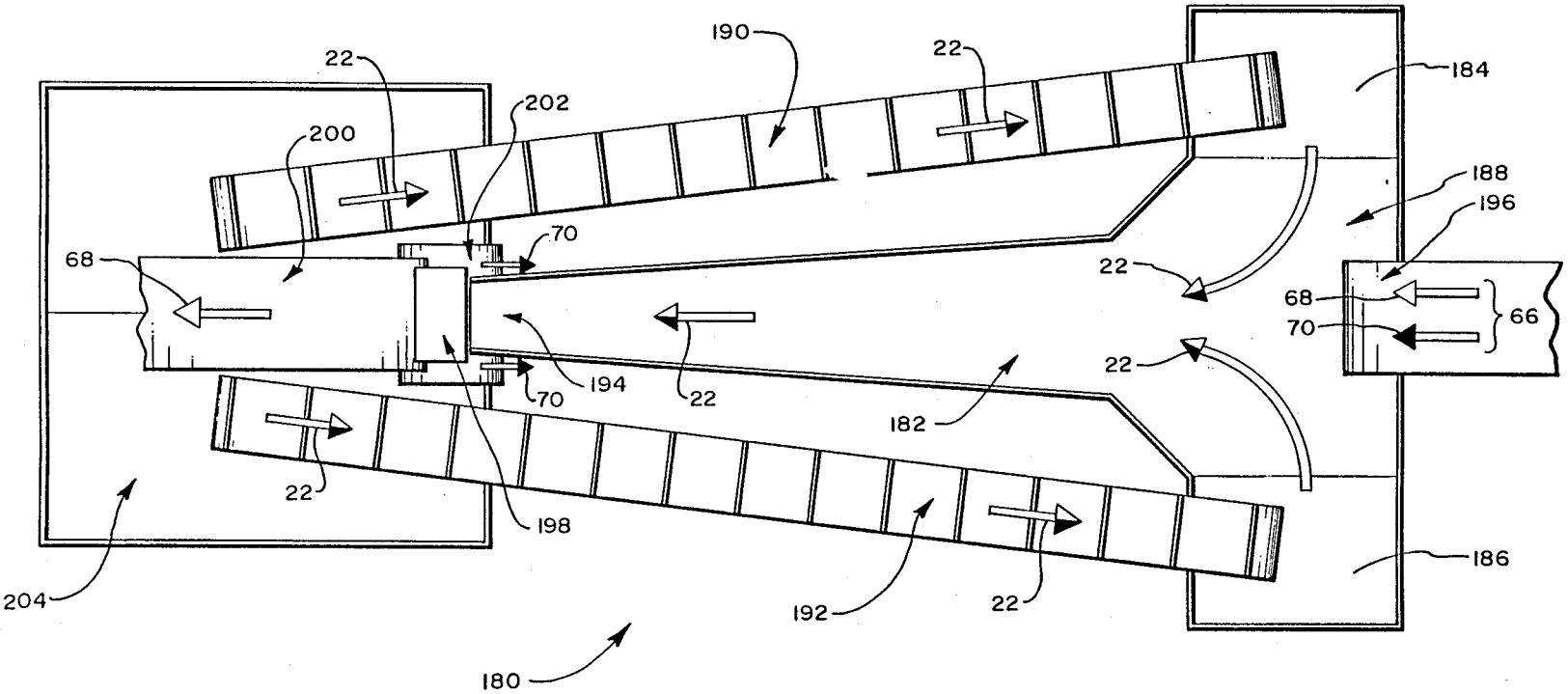
FIG. 6 is a plan view of selected elements of a second embodiment of a separator incorporating the teachings of the present invention.

The operation of separator 10 will be described briefly. Mixture 66, separable into articles of a float and a sink, fraction is fed from mixture conveyor 72 through mixture input baffle 74 to join a layer of fluidization medium 22 for movement along the bottom, sloping surface 46 of trough 12. Fluidization medium 22 is preferably supplied to trough 12 at a point in the direction of flow through trough 12 that preceeds the point at which mixture 66 is fed thereinto. An 8° slope has been found to pertain satisfactorily. During movement of medium 22 and mixture 66 entrained therein through trough 12 gas is forced upwardly therethrough to produce fluidized bed 24. Narrowing of side walls 14, 16 of trough 12 causes the depth of the fluidized bed 24 to increase in the direction of its flow. The flow of gas through fluidized bed 24 is adjusted by means of valves 122, 124, 126, 128 so as to maintain the apparent density of fluidized bed 24 substantially uniform throughout the bed. Provided that the apparent density of fluidized bed 24 is intermediate the densities of the float and sink fractions of mixture 66, articles of the float fraction will rise to the top of fluidized bed 24, while articles of the sink fraction will sink to the bottom thereof. Both float and sink fraction of mixture 66 move with fluidized bed 24 to stream splitter 136, which separates upper and lower layers of fluidized bed 24 with corresponding float and sink fractions of mixture 66 therein for cleaning on first output conveyor 150 and second conveyor 160, respectively. Fluidization medium 22 is collected therebelow on perforated cleaning conveyor 170 through which particles of fluidization medium 22 pass and are deposited in collection bin 52 for recycling to the top or input end 18 of trough 12. An alternative physical arrangement of similar components of another embodiment of a separator 180 incorporating teachings of the present invention is shown in Fig. 6. In contrast to the device depicted earlier, the trough 182 of separator 180 includes input wings 184, 186 for receiving fluidization medium 22 at either side of the top or input end 188 of trough 182. Input wings 184, 186 are 22 inclined toward the center line of trough 182 at approximately 45° so that fluidization medium 22 deposited thereon by either of two medium conveyors 190, 192 slides toward the center of trough 182 and begins to flow toward the lower or output end 194 thereof. During its passage through trough 182, the fluidization medium is fluidized in the manner already described above to produce a fluidization bed capable of separating float and sink fractions of a mixture of agricultural products which are deposited by mixture conveyor 196 into trough 182 at input end 188 thereof.

In a similar manner also already described, upper and lower layers of the fluidized bed with the separated float and sink fractions of the mixture of agricultural products separated and entrained therein are separated by a stream splitter 198 located at output end 194 of trough 182. Particles of fluidization medium 22 pass over stream splitter 198 and are cleaned from the float fraction of the mixture of agricultural products on perforated first output conveyor 200. Particles of fluidization medium 22 are separated from the sink fraction of the mixture by perforated second output conveyor 202. Ultimately, fluidization medium 22 is collected in a large V-bottomed collector bin 204 for transport on medium conveyors 190, 192 to input wings 184, 186 respectively at the top or input end 188 of trough 182. In the example shown in FIG. 6, metering of fluidization medium 22 to regulate the amount thereof 22 supplied to trough 182 necessarily occurs at collection bin 204.

A separator according to the teachings of the present invention was constructed for the purpose of separating potatoes from rocks and clods. A fluidized bed medium 22 was used comprising sand having particles sizes in the range of approximately about 100 microns to about 500 microns, but more preferably in the range of approximately about 150 microns to about 300 microns. Particle size in the fluidization medium can vary over an even broader range, depending on the air flow.

A sand flow volume in the device of 7.4 cubic meters per minute in combination with an air flow volume of 70 cubic meters per minute resulted in an apparent fluidized bed density of 1400–1500 kg/m$^3$. The rocks and clods of the mixture se ranged in size from about 10 millimeters to about 100 millimeters, while the potatoes of the mixture were of a conventionally acceptable commercial size. The constituents of the mixture had the following ranges of densities:

| Constituent | Density (kg/m$^3$) |
|---|---|
| Potatoes | 1010–1090 |
| Clods | 1600–1800 |
| Rocks | 2100–2300 |

Sixty tons (metric) per hour of the above-described mixture, a maximum of 35% of which was rocks and clods, were processed by the sorter. The separation effectiveness of the separator was favorably reflected in the removal from the potatoes of 100% of the rocks of the mixture and 75% to 80% of the clods. A small fraction of the potatoes, approximately two percent, were lost, having been discharged from the separator with the rocks and clods.

The air flow in the device was generated at a pressure of 450 millimeters of water using two blowers in series driven by 10 horsepower (metric) motors and having 48-centimeter wheels. The overall size of the apparatus, including conveyors used to recycle the sand fluidized therein, was 20 meters in length, 4 meters in width, and 3.5 meters in height. The trough for containing the fluidized bed itself was of the type depicted in FIG. 6. It had a total length of 3.6 meters and a width, excluding the input wings, of 2.0 meters.

The inventive apparatus and method described above provides an optimally reliable means for separating agricultural products without the use of wetting fluids and without causing damage to those products. Increasing the depth of the fluidized bed separates the float and sink fractions of the mixture far enough that each can be easily and cleanly extracted. As the fluidized bed is continuously flowing through the trough in which it is contained, without the interference of submerged conveyors or raking mechanisms, separated articles of the float and sink fraction of the mixture are completely and continuously removed from the fluidized bed. The fluidization medium is cleaned of contaminates during each run through the apparatus.

By employing a fluidization medium, such as sand, the method and apparatus disclosed above can be applied to the separation of agricultural products having a wide range of sizes, including in particular large agricultural products An essential aspect of the separation effectiveness that results is the maintenance of the apparent density of the fluidized bed as a constant throughout the entire length of the trough in which it is contained, while at the same time increasing the depth of the fluidized bed in the direction of its flow. This is accomplished by graduating the pressure of the air forced through the fluidization medium corresponding to the distance from the input end of the trough. The use of a gas distribution plate having high resistance to the flow of gas therethrough assists in minimizing the impact on fluidized bed density of changes, sudden or gradual, in its depth.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letter Patent is:

1. An apparatus for separation of a mixture of articles into a float fraction of the mixture made up of articles generally having a first density and a sink fraction of the mixture made up of articles generally having a second density that is greater than the first density, the apparatus comprising:

(a) an inclined channelization means having input and output ends and otherwise enclosed along the length of the sides and bottom thereof so as to form a continuous channel for containing a fluidized bed flowing under the influence of gravity from said input end to said output end thereof, said channelization means being laterally narrower at said output end than at said input end thereof to progressively increase the depth of said fluidized bed in the direction of the flow thereof;

(b) medium feed means for supplying to said input end of said channelization means a fluidization medium from which to create a fluidized bed in said channelization means;

(c) pneumatic means for forcing gas upwardly through said fluidization medium in said channelization means to create from said fluidization medium a fluidized bed having a substantially uniform density regardless of said progressive increase in the depth of said fluidized bed in the direction of the flow thereof, said density of said fluidized bed being intermediate the densities of the articles of the float and sink fractions of the mixture; and (d) mixture feed means for supplying the mixture of articles to said input end of said channelization means for entrainment in said fluidized bed.

2. An apparatus as recited in claim 1, wherein said pneumatic means comprises:

(a) a pressurized gas source;

(b) a perforated gas distribution plate supporting said fluidization medium in said channelization means; and (c) a gas distribution plenum beneath said gas distribution plate communicating with said pressurized gas source to direct gas therefrom through said gas distribution plate.

3. An apparatus as recited in claim 2, wherein gas plenum comprises:

(a) a plurality of distinct gas pressure chambers communicating with said pressurized gas source and arrayed adjacent one to another below said gas distribution plate along the length thereof to direct gas from said pressurized gas source through successive adjacent transverse portions of said gas distribution plate; and (b) a plurality of individually controllable valves, each of said valves being located between a corresponding one of said gas pressure chambers and said pressurized gas source for adjusting individually the pressure of the gas in each of said gas pressure chambers to maintain said density of said fluidized bed uniform throughout said channelization means.

4. An apparatus as recited in claim 2, wherein said gas distribution plate comprises a porous sheet having a high resistance to the passage of gas therethrough.

5. An apparatus as recited in claim 2, wherein said gas is air.

6. An apparatus as recited in claim 1, further comprising a divider means at said output end of said channelization means for separating an upper layer of said fluidized bed with the float fraction of the mixture entrained therein from a lower layer of said fluidized bed with the sink fraction of the mixture entrained therein.

7. An apparatus as recited in claim 6, wherein said divider means comprises a stream splitter horizontally disposed across the width of the output end of said channelization means.

8. An apparatus as recited in claim 7, wherein said stream splitter comprises a secondary pneumatic means for forcing gas upwardly through said upper layer of said fluidized bed with the float fraction of the mixture entrained therein as said upper layer of said fluidized bed flows over said stream splitter.

9. An apparatus as recited in claim 6, further comprising:

(a) a first cleaning means at said output end of said channelization means for separating said fluidization medium from the float fraction of the mixture entrained in said top layer of said fluidized bed; and (b) second cleaning means at said output end of said channelization means for separating said fluidization medium from the sink fraction of the mixture entrained in said lower layer of said fluidized bed.

10. An apparatus as recited in claim 14, wherein said first cleaning means comprises a movable conveyor surface for receiving from said divider means said top layer of said fluidized bed with said float fraction of the mixture entrained therein, said conveyor surface having formed therethrough a plurality of openings of a size intermediate that of the particles of said fluidization medium and the articles of said float fraction of the mixture, whereby the particles of said fluidization medium pass through said conveyor surface and the articles of said float fraction are retained thereon.

11. An apparatus as recited in claim 9, wherein said second cleaning means comprises a movable conveyor surface for receiving from said divider means said lower layer of said fluidized bed with said sink fraction of the mixture entrained therein, said conveyor surface having formed therethrough a plurality of openings of size intermediate that of the particles of said fluidization medium and the articles of said sink fraction of the mixture, whereby said particles of said fluidization medium pass through said conveyor surface and the articles of said sink fraction are retained on said conveyor surface 12. An apparatus as recited in claim 1, wherein said mixture feed means comprises:

(a) a baffle at said input end of said channelization means for depositing said mixture of articles into said fluidizing bed; and (b) a conveyor for feeding said mixture to said baffle.

13. An apparatus as recited in claim 1, wherein said medium feed means comprises:

(a) metering means for regulating the rate of supply of said fluidization medium to said input end of said channelization means; and (b) recirculation means for collecting said fluidization medium from said output end of said channelization means and returning said fluidization medium to said input end thereof.

14. An apparatus as recited in claim 13, wherein said recirculation means comprises:

(a) a collection bin for said fluidization medium located below said output end of said channelization means; and (b) a conveyor for lifting said fluidization medium from said collection bin to said input end of said channelization means.

15. An apparatus as recited in claim 14, wherein said metering means is located at said input end of said channelization means.

16. An apparatus as recited in claim 14, wherein said metering means is located at said collection bin.

17. An apparatus as recited in claim 1, wherein said fluidization medium comprises sand.

18. An apparatus as recited in claim 1, wherein said channelization means comprises a trough inclined downwardly from said input end to said output end of said channelization means, said trough being provided with side walls horizontally spaced closer together at said output end of said channelization means than at said input end thereof.

19. An apparatus as recited in claim 18, wherein said side walls have a greater height at said output end of said channelization means than at said input end thereof.

20. An apparatus as recited in claim 18, wherein the steepness of the incline of said trough is adjustable.

21. An apparatus as recited in claim 18, wherein the horizontal spacing of said side walls at said output end of said channelization means is adjustable.

22. An apparatus for separation of a mixture of articles into a float fraction of the mixture made up of articles generally having a first density and a sink fraction of the mixture made up of articles generally having a second density that is greater than the first density, the apparatus comprising:

(a) an inclined channelization means having input and output ends and otherwise enclosed along the length of the sides and bottom thereof so as to form a continuous channel for containing a fluidized bed flowing under the influence of gravity from said input end to said output end thereof, said channelization means being laterally narrower at said output end than at said input end thereof to progressively increase the depth of said fluidized bed in the direction of the flow thereof;

(b) medium feed means for supplying to said input end of said channelization means a fluidization medium from which to create a fluidized bed in said channelization means;

(c) a pressurized gas source for forcing gas upwardly through said fluidization medium in said channelization means to create from said fluidization medium a fluidized bed.

(d) pressure differentiation means communicating with said pressurized has source for graduating the pressure of said gas forced upwardly through said fluidization medium to maintain the density of said fluidized bed substantially uniform throughout said channelization means regardless of said progressive increase in the depth of said fluidized bed in the direction of the flow thereof; and (e) mixture feed means for supplying the mixture of articles to said input end of said channelization means for entrainment in said fluidized bed.

23. An apparatus as recited in claim 22, wherein said pressure differentiation means comprises:

(a) a perforated gas distribution plate supporting said fluidization medium in said channelization means; and (b) sectionalizing means communicating with said pressurized gas source to direct gas therefrom through successive adjacent transverse portions of said gas distribution plate, the pressure of said gas being graduated to increase along said distribution plate normal said transverse portions thereof in a manner corresponding approximately to the distance along said gas distribution plate from said input end of said channelization means.

24. An apparatus as recited in claim 23, wherein said gas sectionalizing means comprises:

(a) a plurality of distinct gas pressure chambers communicating with said pressurized gas source and arrayed adjacent one to another below said gas distribution plate along the length thereof; and (b) a plurality of individually controllable valves, each of said valves being located between a corresponding one of said gas pressure chambers and said pressurized gas source for adjusting individually the pressure of the gas in each of said gas pressure chambers.

25. An apparatus as recited in claim 24, wherein said gas distribution plate affords a high resistance to the flow of gas therethrough.

26. An apparatus as recited in claim 22, further comprising a stream splitter horizontally disposed across the width of said output end of said channelization means for separating an upper layer of said fluidized bed with the float fraction of the mixture entrained therein from a lower layer of the fluidized bed with the sink fraction of the mixture entrained therein.

27. An apparatus for separation of a mixture of articles into a float fraction of the mixture made up of articles generally having a first density and a sink fraction of the mixture made up of articles generally having a second density that is greater than the first density the apparatus comprising:

(a) channelization means having input and output ends for containing a fluidized bed flowing under the influence of gravity from said input end to said output end thereof, said channelization means being laterally narrower at said output end than said input end thereof to increase the depth of said fluidized bed in the direction of the flow thereof;

(b) medium feed means for supplying to said input end of said channelization means a fluidization medium form which to create a fluidized bed in said channelization means;

(c) a pressurized gas source for forcing gas upwardly through said fluidization medium in said channelization means to create from said fluidization medium a fluidized bed;

(d) pressure differentiation means communicating with said pressurized gas source for graduating the pressure of said gas forced upwardly through said fluidization medium to maintain the density of said fluidized bed substantially uniform throughout said channelization means regardless of said increase in the depth of said fluidized bed in the direction of the flow thereof said pressure differentiation means comprising:

(i) a perforated gas distribution plate supporting said fluidization medium in said channelization means, the perforation size and perforation density of said plate being graduated along the length of said channelization means, whereby the resistance to the passage of gas through said gas distribution plate is reduced corresponding to the distance along said gas distribution plate from said input end of said channelization means to said output end thereof; and (ii) a gas distribution plenum beneath said gas distribution plate communicating with said pressurized gas source to direct gas therefrom through said distribution plate; and (e) mixture feed means for supplying the mixture of articles to said input end of said channelization means for entrainment in said fluidized bed.

28. An apparatus as recited in claim 27, wherein said gas distribution plate affords a high resistance to the flow of gas therethrough.

29. An apparatus for separation of a mixture of articles into a float fraction of the mixture made up of articles generally having a first density and a sink fraction of the mixture made up of articles generally having a second density that is greater than the first density, the apparatus comprising:

(a) an inclined channelization means having input and output ends and otherwise enclosed along the length of the sides and bottom thereof so as to form a continuous channel for containing a fluidized bed flowing under the influence of gravity from said input end to said output end thereof, said channelization means being laterally narrower at said output end than at said input end thereof to progressively increase the depth of said fluidized bed in the direction of the flow thereof;

(b) medium feed means for supplying to said input end of said channelization means a fluidization means from which to create a fluidized bed in said channelization means;

(c) a perforated gas distributor plate supporting said fluidization medium in said channelization means;

(d) a pressurized gas source;

(e) a plurality of distinct gas pressure chambers communicating with said pressurized gas source and arrayed adjacent one another beneath said gas distributor plate along the length thereof to direct gas from said pressurized gas source upwardly through successive adjacent transverse portions of said gas distribution plate and said fluidization medium to produce a fluidized bed therefrom;

(f) a plurality of individually controllable valves, each of said valves being located between a corresponding one of said gas pressure chambers and said pressurized gas source for adjusting individually the pressure of the gas in each of said gas pressure chambers to determine the density of said fluidization bed and to maintain the density of said fluidized bed uniform throughout said channelization means regardless of said progressive increase in the depth of said fluidization bed in the direction of the flow thereof, said density of said fluidized bed being intermediate the densities of the articles of the float and sink fractions of the mixture; and (g) mixture feed means for supplying the mixture of articles to said input end of said channelization means for entrainment in said fluidized bed.

30. An apparatus as recited in claim 29, wherein the gas distribution plate comprises a porous sheet having a high resistance to the passage of gas therethrough.

31. An apparatus as recited in claim 29, further comprising a stream splitter horizontally disposed across the width of said channelization means for separating an upper layer of said fluidized bed with the float fraction of the mixture entrained therein from a lower layer of fluidized bed with the sink fraction of the mixture entrained therein.

32. An apparatus as recited in claim 31, wherein said stream splitter comprises:

(a) a perforated upper surface;

(b) a gas manifold beneath said perforated upper surface communicating with said pressured gas source to direct gas through said perforated upper surface and said upper layer of said fluidized bed with the float fraction of the mixture entrained therein as said upper layer of said fluidized bed flows over said stream splitter.

33. An apparatus as recited in claim 29, wherein said medium feed comprises:

(a) metering means for regulating the rate of supply of said fluidization medium to said input end of said channelization means; and (b) recirculation means for collecting said medium from said output end of said channelization means and returning said medium to said input end thereof.

34. An apparatus as recited in claim 29, wherein said channelization means comprises a trough inclined downwardly from said input end to said output end of said channelization means, said trough being provided with side walls horizontally spaced closer together at said output end of said channelization means then at said input end thereof.

35. An apparatus for separation of a mixture of articles into a float fraction of the mixture made up of articles generally having a first density and a sink fraction of the mixture made up of articles generally having a second density that is greater than the first density, the separator comprising:

(a) a trough having input and output ends and being inclined downwardly from said input end to said output end thereof, said trough being provided with side walls horizontally spaced progressively closer together at said output end of said trough than at said input end thereof, thereby to contain a fluidized bed flowing under the influence of gravity from said input end to said output end of said trough and to progressively increase the depth of said fluidized bed in the direction of the flow thereof;

(b) recirculation means for collecting at said output end of said trough a fluidization medium from which to produce a fluidized bed and conveying said fluidization medium to said input end of said trough;

(c) metering means for regulating the rate of supply of said fluidization medium to said input end of said trough;

(d) pneumatic means for forcing gas upwardly through said fluidization medium in said trough to create from said fluidization medium a fluidized bed having a substantially uniform density regardless of said progressive increase in the depth of said fluidized bed in the direction of the flow thereof, said density of said fluidized bed being intermediate the densities of the articles of the float an sink fractions of the mixture; and (e) divider means at said output end of said trough for separating an upper layer of said fluidized bed with the float fraction of the mixture entrained therein from a lower layer of said fluidized bed with the sink fraction of the mixture entrained therein.

36. An apparatus as recited in claim 35, further comprising a movable conveyor surface for receiving from said divider means said top layer of said fluidized bed with said float fraction of the mixture entrained therein, said conveyor surface having formed therethrough a plurality of openings of size intermediate that of the particles of said fluidization medium and the articles of said float fraction of the mixture, whereby the particles of said fluidization medium pass through said conveyor surface and the articles of the float fraction are retained thereon.

37. An apparatus as recited in claim 35, further comprising a movable conveyor surface for receiving from said divider means said lower layer of said fluidized bed with said sink fraction of the mixture entrained therein, said conveyor surface having formed therethrough a plurality of openings of size intermediate that of the particles of said fluidization medium and the articles of the sink fraction of the mixture, whereby the particles of said fluidization medium pass through said conveyor surface and articles of the sink fraction are retained thereon.

38. An apparatus as recited in claim 35, wherein said recirculation means comprises:

(a) a collection bin for said fluidization means below said output end of said channelization means; and (b) a conveyor for lifting said fluidization medium from said collection bin to said input end of said trough.

39. An apparatus as recited in claim 35, wherein said pneumatic means comprises:

(a) a pressurized gas source;

(b) a perforated gas distributor plate supporting said fluidization medium in said trough; and (c) a gas distribution plenum beneath said gas distribution plate communicating with said pressurized gas source to direct gas therefrom through said as distribution plate.

40. An apparatus as recited in claim 39, wherein said gas plenum comprises:

(a) a plurality of distinct gas pressure chambers communicating with said pressurized gas source arrayed adjacent one another below said gas distribution plate along the length thereof to direct gas from said pressurized gas source through successive adjacent transverse portions of said gas distribution plate; and (b) a plurality of individually controllable valves, each of said valves being located between a corresponding one of said gas pressure chambers and said pressurized gas source for adjusting individually the pressure of the gas in each of said gas pressure chambers to maintain said density of said fluidization bed uniform throughout said trough.

41. An apparatus as recited in claim 35, wherein said gas distribution plate comprises a porous sheet having a high resistance to the passage of gas therethrough.

42. An apparatus as recited in claim 35, wherein said divider means comprises a stream splitter horizontally disposed across the width of the output end of said trough.

43. An apparatus as recited in claim 42, wherein said stream splitter comprises:

(a) a perforated upper surface;

(b) a gas manifold beneath said perforated upper surface in communication with said pressurized gas source to direct gas therefrom through said perforated upper surface and said upper layer of said fluidized bed with said float fraction of the mixture entrained therein as said upper layer of said fluidized bed flows over said stream splitter.

44. An apparatus as recited in claim 37, further comprising:

(a) a first cleaning means at said output end of said trough for separating said fluidization medium of said upper layer of said fluidized bed from the float fraction of the mixture entrained therein; and (b) second cleaning means at said output end of said channelization means for separating said fluidization medium of said lower layer of said fluidized bed from the sink fraction of the mixture entrained therein.

45. An apparatus for separation of a mixture of articles into a float fraction of the mixture made up of articles generally having a first density and a sink fraction of the mixture made up of articles generally having a second density that is greater than the first density, the apparatus comprising:

(a) a trough having input and output ends and being inclined downwardly from said input end to said output end thereof, said trough being provided with side walls horizontally spaced closer together at said output end of said trough than at said input end thereof, thereby to contain a fluidized bed flowing under the influence of gravity from said input end to said output end of said trough and to progressively increase the depth of said fluidized bed in the direction of the flow thereof;

(b) a collection bin for a fluidization medium from which to produce a fluidized bed flowing from said input end to said output end of said trough, said collection bin located at said output end of said trough;

(c) a conveyor for lifting said fluidization medium from said collection bin to said input end of said trough;

(d) a perforated gas distributor plate beneath said fluidization medium in said trough;

(e) a pressurized gas source;

(f) a plurality of distinct gas pressure chambers communicating with said pressurized gas source and arrayed adjacent one another beneath said gas distributor plate along the length thereof to direct gas from said pressurized gas source upwardly through successive adjacent transverse portions of said gas distribution plate and said fluidization medium in said trough to produce from said fluidization means a fluidized bed;

(g) a plurality of individually controllable valves, each of said valves being located between a corresponding one of said gas pressure chambers and said pressurized gas source for adjusting individually the pressure of the gas in each of said gas pressure chambers to maintain the density of said fluidized medium uniform throughout the trough regardless of said progressive increase in the depth of said fluidized bed in the direction of the flow thereof, said density of said fluidized bed being intermediate the densities of the articles of the float and sink fractions of the mixture of articles;

(h) mixture feed means for supplying the mixture of articles to said input end of said trough for entrainment in said fluidized bed;

(i) divider means at said output end of said trough for separating an upper layer of said fluidized bed with the float fraction of the mixture entrained therein from a lower layer of said fluidization bed with the sink fraction of the mixture entrained therein; and (j) first and second cleaning means interposed between said divider means and said collection bin for separating said fluidization medium from the float fraction and the sink fraction respectively of the mixture entrained in corresponding layers of said fluidized bed.

46. An apparatus as recited in claim 45, wherein the particles of said fluidization medium have an average diameter in the range of approximately about 100 microns to about 500 microns.

47. An apparatus as recited in claim 46, wherein the particles of said fluidization medium have diameters in the range of approximately about 150 microns to about 300 microns.

48. An apparatus as recited in claim 45, wherein said fluidization medium is sand.

49. An apparatus as recited in claim 45, wherein said mixture feed means supplies the mixture of articles to said input end of said trough at a point therein in the direction of said flow of said fluidized bed subsequent to the point at which said fluidization medium is lifted to said input end of said fluidization medium.

50. A method for separating a mixture of articles into a float fraction of the mixture made up of articles generally having a first density and a sink fraction of the mixture made up of articles generally having a second density that is greater than the first density, the method comprising the steps of:

(a) supplying to the upper end of an inclined trough a fluidization medium from which to produce a fluidized bed flowing under the influence of gravity through said trough;

(b) forcing gas upwardly through said fluidization medium in said trough to produce therefrom a fluidization bed;

(c) laterally narrowing the walls of said trough from said input to said output ends thereof to progressively increase the depth of said fluidized bed in the direction of the flow thereof;

(d) adjusting the pressure of said gas forced through said fluidization medium to maintain said fluidized bed at a substantially uniform density throughout said trough regardless of said progressive increase in the depth of said fluidized bed in the direction of the flow thereof, said density of said fluidized bed being intermediate the densities of the articles of the float and sink fractions of the mixture of articles;

(e) feeding to the upper end of said trough the mixture of articles for entertainment in said fluidized bed, whereby the float fraction and the sink fraction of the articles of the mixture migrate to an upper and a lower layer respectively of said fluidized bed as said fluidized bed flows through said trough;

(f) separating said upper layer of said fluidized bed with said float fraction of the mixture entrained therein from the said lower layer of said fluidized bed with said sink fraction of the mixture entrained therein; and (g) cleaning said fluidization medium of said separated upper and lower layers from the float and sink fractions respectively of the mixture.

51. A method as recited in claim 50, wherein said step of adjusting the pressure of said gas includes the step of directing gas through a perforated gas distribution plate supporting said fluidization medium in said trough, said gas distribution plate having a high resistance to the passage of said gas therethrough.

52. A method as recited in claim 51, wherein said step of adjusting the pressure of said gas comprises the steps of:

(a) providing a plurality of distinct gas pressure chambers arrayed adjacent one another below said gas distribution plate along the length thereof, each of said gas pressure chambers communicating with a pressurized gas source to direct gas therefrom through successive adjacent transverse portions of said gas distribution plate; and (b) adjusting each of a plurality of valves located individually between a corresponding one of said gas pressure chambers and said pressurized gas source to adjust individually the pressure of the gas in each of said pressure chambers to maintain said fluidized bed at a substantially uniform density throughout said trough regardless of said increase in the depth of said fluidized bed.

53. A method as recited in claim 50, wherein said steps of supplying and feeding are conducted such that the mixture of articles is fed to said upper end of said trough at a point therein in the direction of the flow of said fluidized bed subsequent to the point at which said fluidization medium is supplied to said upper end of said trough.

54. A method for separating a mixture of articles into a float fraction of the mixture made up of articles generally having a first density and a sink fraction of the mixture made up of articles generally having a second density that is greater than the first density the method comprising the steps of:

(a) supplying to the upper end of an inclined trough a fluidization medium from which to produce a fluidized bed flowing under the influence of gravity through said trough;

(b) forcing gas upwardly through said fluidization medium in said trough to produce therefrom a fluidized bed;

(c) increasing the depth of said fluidized bed in the direction of the flow thereof;

(d) adjusting the pressure of said gas forced through said fluidization medium to maintain said fluidized bed at a substantially uniform density throughout said trough regardless of said increase in the depth of said fluidized bed in the direction of the flow thereof, said density of said fluidized bed being intermediate the densities of the articles of the float and sink fractions of the mixture of articles, said step of adjusting the pressure comprises the steps:

(i) directing gas through a perforated gas distribution plate supporting said fluidization medium in said trough, said gas distribution plate having a high resistance to the passage of said gas therethrough;

(ii) providing a plurality of distinct gas pressure chambers arrayed adjacent one another below said gas distribution plate along the length thereof, each of said gas pressure chambers communicating with a pressurized gas source to direct gas therefrom through successive adjacent transverse portions of said gas distribution plate; and (iii) individually adjusting each of a plurality of valves located between a corresponding one of said gas pressure chambers and said pressurized gas source to adjust individually the pressure of the gas in each of said pressure chambers to maintain said fluidized bed at a substantially uniform density throughout said trough regardless of said increase in the depth of said fluidized bed, said step of individually adjusting each of a plurality of valves comprising the step of graduating the pressure of the gas in each of said gas pressure chambers so as to increase the pressure of the gas therein corresponding to the distance along said gas distribution plate from said input end of said trough;

(e) feeding to the upper end of said trough the mixture of articles for entrainment in said fluidized bed, whereby the float fraction and the sink fraction of the articles of the mixture migrate to an upper and a lower layer respectively of said fluidized bed as said fluidized bed flows through said trough;

(f) separating said upper layer of said fluidized bed with said float fraction of the mixture entrained therein from the said lower layer of said fluidized bed with said sink fraction of the mixture entrained therein; and (g) cleaning said fluidization medium of said separated upper and lower layers from the float and sink fractions respectively of the mixture.

* * * * *

UNITED STATES PATENT AND TRADEMARK OFFICE

CERTIFICATE OF CORRECTION

PATENT NO. : 4,861,464

DATED : August 29, 1989

INVENTOR(S) : Arthur Zaltzman et al.

It is certified that error appears in the above-identified patent and that said Letters Patent is hereby corrected as shown below:

Column 1, line 11, "gading" should be --grading--
Column 2, line 59, "liquid" should be --liquid.--
Column 6, line 23, "thereof" should be --thereof.--
Column 6, line 56, delete "22"
Column 11, line 27, "f a gas plenum" should be --of a gas plenum--
Column 13, line 59, "preceeds" should be --precedes--
Column 14, line 16, "An alternative" should begin a new paragraph, rather than continuing on the same line
Column 14, line 23, delete "22"
Column 14, line 57, "particles sizes" should be --particle sizes--
Column 14, line 67, "se" should be --separated--
Column 14, line 67, "ranged" should be --range--
Column 17, line 50, "surface" should be --surface.--

Signed and Sealed this

Twenty-second Day of October, 1991

*Attest:*

HARRY F. MANBECK, JR.

*Attesting Officer*

*Commissioner of Patents and Trademarks*